US011300251B2

(12) United States Patent
Hollaender et al.

(10) Patent No.: US 11,300,251 B2
(45) Date of Patent: Apr. 12, 2022

(54) INTEGRATED LIGHT SOURCE DRIVER

(71) Applicant: LEDVANCE GmbH, Garching bei München (DE)

(72) Inventors: Peter Hollaender, Friedberg (DE); Max Zimmermann, Augsburg (DE); Ulrich Biebel, Rennertshofen (DE)

(73) Assignee: LED VANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/046,031

(22) Filed: Jul. 26, 2018

(65) Prior Publication Data

US 2019/0032862 A1 Jan. 31, 2019

(30) Foreign Application Priority Data

Jul. 26, 2017 (DE) ..... 102017116949.0

(51) Int. Cl.

| | |
|---|---|
| ***F21V 21/00*** | (2006.01) |
| ***F21K 9/278*** | (2016.01) |
| ***F21K 9/238*** | (2016.01) |
| ***F21V 19/00*** | (2006.01) |
| *F21Y 107/90* | (2016.01) |

(Continued)

(52) U.S. Cl.

CPC ..... *F21K 9/278* (2016.08); *F21K 9/238* (2016.08); *F21V 19/0045* (2013.01); *F21Y 2103/10* (2016.08); *F21Y 2105/16* (2016.08); *F21Y 2107/50* (2016.08); *F21Y 2107/90* (2016.08); *F21Y 2115/10* (2016.08)

(58) Field of Classification Search

CPC ..... F21K 9/278; F21K 9/238; F21K 9/272; F21K 9/23; F21K 9/27; F21K 9/235; F21K 9/237; F21V 19/0045; F21V 23/06; F21V 23/003; F21V 17/104; F21V 17/16; F21V 19/003; F21V 23/006; F21V 23/005; F21V 23/009; F21V 23/008; F21V 29/83; F21V 19/004; F21V 19/001; F21Y 2107/50; F21Y 2115/10; F21Y 2107/90; F21Y 2105/16; F21Y 2103/10; F21Y 2105/10; F21Y 2105/00; H05B 45/00; H01R 12/57; H01R 33/7642; H01R 12/73; H01R 31/06; H05K 1/117; H05K 2201/0311; H05K 2201/09472; H05K 3/366; H05K 1/14; H05K 2201/048; H05K 2201/10106; F21S 2/00

See application file for complete search history.

(56) References Cited

U.S. PATENT DOCUMENTS 3,748,980 A * 7/1973 Brandt ..... G03B 15/0426 396/197
9,157,590 B2 * 10/2015 Burkard ..... F21K 9/00

(Continued)

FOREIGN PATENT DOCUMENTS

DE 102014214175 1/2016
DE 102015216662 A1 3/2017

*Primary Examiner* — Omar Rojas Cadima
(74) *Attorney, Agent, or Firm* — Hayes Soloway PC

(57) ABSTRACT

A lamp base includes a housing for at least partial accommodation of a carrier for a light source. Two mutually-opposing guide rails are provided in the housing for the form-fitted insertion of the carrier. The technology is particularly applicable to carriers with LEDs as light sources and addresses problems with adhesive or soldered attachment of the light source carrier.

20 Claims, 3 Drawing Sheets

(51) Int. Cl.

| | |
|---|---|
| *F21Y 105/16* | (2016.01) |
| *F21Y 103/10* | (2016.01) |
| *F21Y 115/10* | (2016.01) |
| *F21Y 107/50* | (2016.01) |

(56) References Cited

U.S. PATENT DOCUMENTS

| | | | | |
|---|---|---|---|---|
| 2003/0180037 | A1* | 9/2003 | Sommers | G03B 15/05 396/155 |
| 2007/0285949 | A1* | 12/2007 | Lodhie | F21V 21/35 362/648 |
| 2009/0273939 | A1* | 11/2009 | Oesterheld | H05K 1/141 362/362 |
| 2011/0248631 | A1* | 10/2011 | Chuang | F21V 19/0045 315/32 |
| 2012/0106153 | A1* | 5/2012 | Huang | F21K 9/232 362/249.02 |
| 2012/0268941 | A1 | 10/2012 | Shih et al. | |
| 2014/0204572 | A1* | 7/2014 | Spinelli | F21V 15/013 362/223 |
| 2014/0313731 | A1* | 10/2014 | Kwak | F21V 29/004 362/294 |
| 2016/0131310 | A1* | 5/2016 | Lu | F21K 9/238 362/362 |
| 2016/0186969 | A1* | 6/2016 | Zhao | F21V 15/015 362/221 |
| 2016/0298812 | A1 | 10/2016 | Chen | |
| 2016/0348851 | A1* | 12/2016 | Amrine, Jr. | F21V 23/06 |
| 2018/0058637 | A1* | 3/2018 | Thiel | F21V 3/02 |

* cited by examiner

INTEGRATED LIGHT SOURCE DRIVER

CROSS-REFERENCE TO RELATED APPLICATIONS AND PRIORITY

This patent application claims priority from German Patent Application No. 102017116949.0 filed Jul. 26, 2017, which is herein incorporated by reference in its entirety.

TECHNICAL FIELD

The present invention relates to a lamp base, specifically for an LED lamp, and to a lamp, specifically an LED lamp, incorporating such a lamp base.

BACKGROUND

Lamps or LED lamps are extensively known. They customarily comprise a light source carrier and a light source driver. The light source carrier comprises a light source proper, for example one or more LEDs, and the light source driver is designed to actuate or drive the light source proper. In general, both the light source carrier and the light source driver are at least partially arranged in a lamp base.

Customarily, the light source carrier, which is generally of a plate-type design, is adhered or soldered onto the light source driver. In general, this means that a defective light source carrier results in a defective lamp on economic grounds.

SUMMARY OF THE INVENTION

On the basis of the known prior art, the object of the present invention is to provide an improved lamp base.

Specifically, the invention is intended to provide a lamp base in which a connection can be formed between the light source carrier and the light source driver with no material bonding, thus permitting, for example, the simple and cost-effective replacement of a defective light source carrier.

This object is achieved by a lamp base having the characteristics of claim 1. Advantageous further developments proceed from the subordinate claims.

Accordingly, a lamp base for a lamp, specifically an LED lamp, is proposed, comprising a housing for the at least partial accommodation of a carrier for a light source, wherein two mutually-opposing guide rails are provided in the housing for the form-fitted insertion of the carrier.

The lamp base thus incorporates a housing, which is designed for the accommodation of a light source carrier for carrying a light source. The accommodation of the light source carrier proceeds by means of two mutually-opposing guide rails, which are preferably arranged within the housing. By means of these two mutually-opposing guide rails, the light source carrier can be accommodated in the housing in a form-fitted manner. To this end, each of the guide rails preferably incorporates at least one rail opening with an internal clearance. The light source carrier is, moreover, of a thickness which corresponds to this internal clearance, such that the light source carrier can be inserted into the lamp base in a simple and form-fitted manner.

It is particularly advantageous that the light source carrier can be arranged in the lamp base exclusively by means of form-fitting, so defective light source carriers can be replaced in a simple manner during the service life of the lamp.

Preferably, both of the two mutually-opposing guide rails incorporate a rail opening, arranged to face each other.

The rail openings are thus arranged within the guide rails, so the rail openings face each other. This permits the accommodation of the carrier, independently of the arrangement of the guide rails. For example, the housing is a tube, or of tubular design, and the two guide rails are arranged at 10 o'clock and 2 o'clock, wherein the rail openings in the guide rails face each other. In this case, the light source carrier can be inserted in the housing in the direction of the secant between 10 o'clock and 2 o'clock, provided that the light source carrier is of the customary plate-type design.

In a specifically preferred form of embodiment, the housing is a symmetrical design, such that the guide rails are uniformly distributed within the housing. For example, the housing is a tube, or a tubular design, and the two guide rails are arranged at 9 o'clock and 3 o'clock within the housing.

Preferably, the rail openings extend over the full length of the respective two mutually-opposing guide rails.

Thus, in the simplest case, the guide rails incorporate a slot over their full length. Particularly advantageously, a particularly deep insertion of the light source carrier, thereby results in a lamp of a compact design.

In a preferred configuration, a limit stop to limit the depth of insertion of the carrier along the guide rails is provided, wherein it is specifically preferred that the limit stop is provided in the rail opening of the respective guide rails. Thus, upon the form-fitted insertion of the carrier into the guide rails, it is ensured that the light source carrier cannot be inserted beyond a predefined position. In this manner, moreover, assembly can be simplified, as the presence of the limit stop permits the carrier to be inserted with no further controls. The light source carrier, if it has been inserted to the depth of the limit stop, is thus automatically in the correct position. Additionally, the light source carrier is not easily pushed out again from the guide rails.

The lamp base preferably incorporates a driver receptacle in the housing, which is designed for the at least partial accommodation of a light source driver in the housing.

The driver receptacle is thus arranged within the housing and is preferably designed for the formation of a form-fitted connection between the light source driver and the housing.

It is specifically preferred that the driver receptacle is designed such that the light source driver can be accommodated in the housing, such that the light source carrier is substantially perpendicular to the light source driver. For example, the housing is a tube, or is of tubular design, and the driver receptacle is a recess or gradation which completely encircles the tube and is arranged within the tube, such that the light source driver can be snap-fitted into the housing in a form-fitted manner.

Preferably, the lamp base is of a symmetrical design in at least one axis and incorporates a uniform distribution of the guide rails in the housing.

Particularly advantageously here, the symmetrical design permits cost-effective manufacture, for example by the production of two symmetrical half-shells using an injection-molding process.

Preferably, the housing and the guide rails are formed of one and the same electrically non-conductive material.

Accordingly, both the housing and the guide rails are electrically non-conductive. Moreover, the guide rails and the housing are formed of the same electrically non-conductive material. Particularly advantageous in the case of this combination of one and the same electrically non-conductive material is in particular the possibility of manufacturing the housing by a simple injection-molding method, for example by means of two half-shells or as a one-piece molding.

Preferably, the lamp base incorporates a light source driver, which is arranged in the housing such that the light source carrier, upon the insertion thereof in the two mutually-opposing guide rails, is substantially perpendicular to the light source driver.

Such an arrangement of the light source driver, specifically in the housing, can be permitted for example by a driver receptacle, as described heretofore or hereinafter.

Preferably, the light source driver incorporates a first and a second contact clip, which are arranged with a mutual clearance on the light source driver such that, within the housing, they are oriented adjacently to the guide rails.

The light source driver thus incorporates two contact clips, which are designed to form an electrical contact between the light source driver and the light source carrier. A contact clip configured in the form of two U-brackets is specifically preferred, in order to accommodate the light source carrier between the U-brackets.

Moreover, the contact clips are arranged on the light source driver such that they are positioned in proximity to the guide rails and are oriented in the same direction as the guide rails.

By the employment of contact clips, and the arrangement thereof on the light source driver, by the insertion of the light source carrier into the base, a form-fitted connection is also formed between the light source carrier and the light source driver.

The employment of contact clips on the light source driver further leads to a type of frame, comprised of a guide rail, a contact clip and a guide rail, which permits the arrangement of the light source carrier within the housing with an exceptionally small clearance.

The above-mentioned object is further achieved by a lamp having the characteristics of claim 10.

Accordingly, a lamp, specifically an LED lamp is proposed, comprising a lamp base as described heretofore or hereinafter, and a light source carrier for the support of a light source, wherein the light source carrier has been the inserted in a form-fitted manner by means of the mutually-opposing guide rails which are arranged in the housing, wherein the light source carrier incorporates at least two contact surfaces, arranged with a mutual clearance, which are designed for contact clips from the light source driver, to form an electrical contact between the at least one light source and one light source driver for the actuation of the at least one light source.

The light source carrier thus incorporates two contact surfaces, which are arranged on the light source carrier such that they engage with the contact clips of the light source driver. The light source carrier is thus energized by means of its contact surfaces via the contact clips of the light source driver.

BRIEF DESCRIPTION OF THE FIGURES

Preferred further embodiments of the invention are described in greater detail in the following description of the figures. In the figures.

DETAILED DESCRIPTION OF PREFERRED EXEMPLARY EMBODIMENTS

Preferred exemplary embodiments are described hereinafter, with reference to the figures. Identical or similar components, or components with an equivalent function are identified in the various figures by the same reference symbols, and any repeated description of these elements has been omitted, to some extent, in the interests of avoiding redundancy.

Figure 1A:
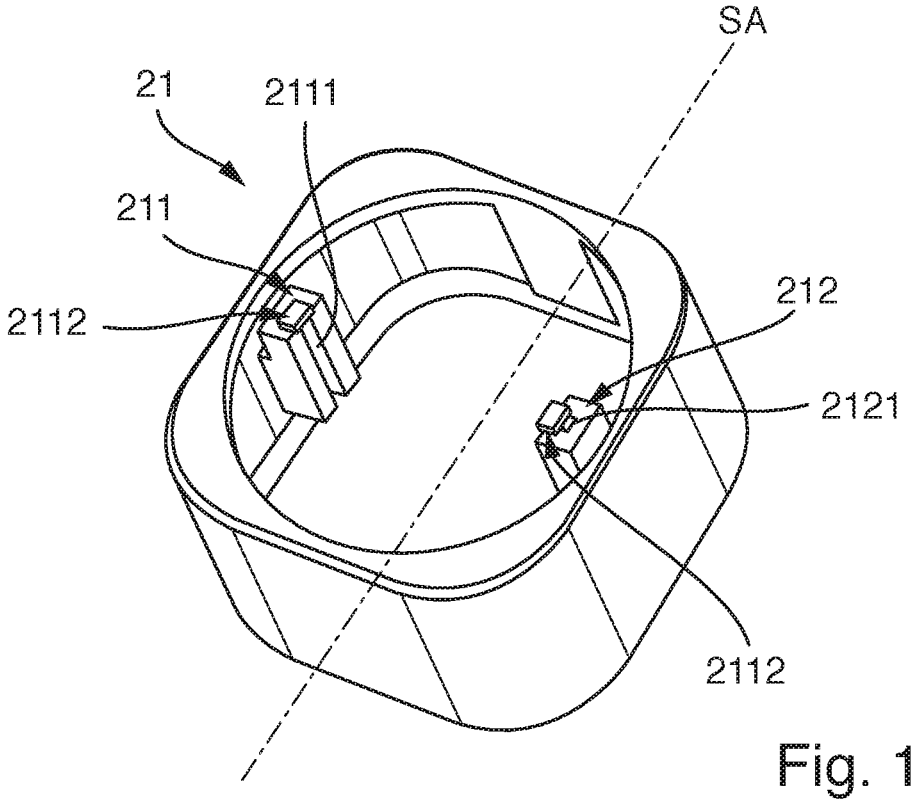
FIG. 1A shows a perspective overhead view of the housing of a lamp base according to the invention.

FIG. 1A shows a schematic representation of a perspective overhead view of the housing 21 of a lamp base 20 according to the invention.

The housing 21 is formed of an electrically non-conductive material, for example by means of an injection-molding method, and incorporates, in its interior, a first guide rail 211 and a second guide rail 212.

The guide rails 211, 212 are arranged in mutual opposition in the housing 21 and are designed to accommodate a light source carrier 22 in a form-fitted manner.

To this end, the two mutually-opposing guide rails 211, 212 each incorporate a rail opening 2111, 2121, wherein the rail openings 2111, 2121 are arranged to face each other.

The rail openings 2111, 2121 in the two opposing guide rails 211, 212 are configured over the full extent of their respective guide rail here, specifically over the full length thereof. This permits the light source carrier 22 to be inserted into the housing 21 to the maximum possible depth, thereby resulting in a compact design of the lamp which incorporates the housing 21.

Additionally or alternatively, a schematically-represented limit stop 2112 is provided, with which the light source carrier 22 engages upon insertion, in order to achieve the clearly-defined insertion of the light source carrier 22. By the provision of the limit stop 2112, it can specifically be prevented that the light source carrier 22 is inserted too far or is entirely pushed out of the guide rails 211, 212. Assembly is simplified accordingly.

The housing 21 is, moreover, of symmetrical design about the axis SA, and incorporates a uniform distribution of guide rails in the housing 21. Moreover, the housing 21 and the guide rails 211, 212 are formed of one and the same electrically non-conductive material. A design of this type permits, inter alia, the manufacture of the housing 21 by the two-shell principle, wherein both shells are identical and can be manufactured by an injection-molding method, using the same template.

Figure 1B:
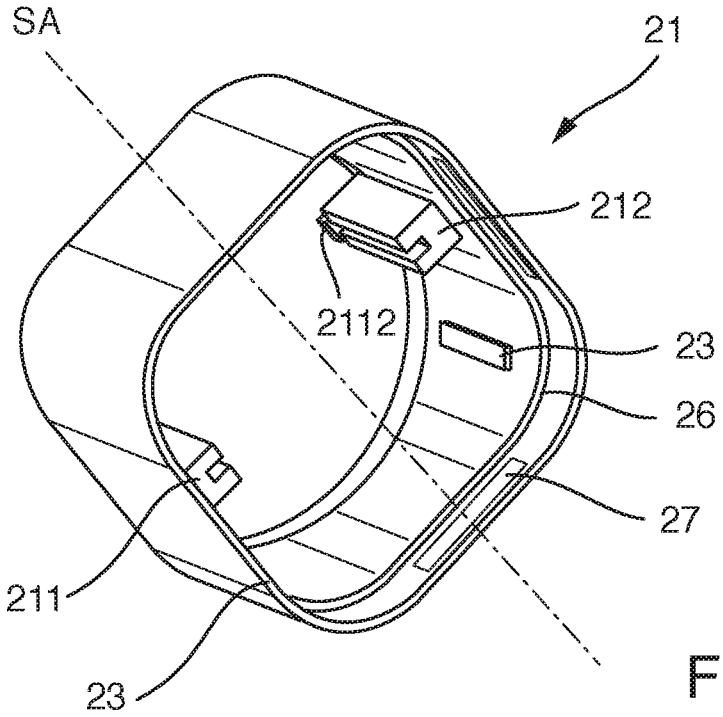
FIG. 1B shows a perspective underside view of the housing of a lamp base according to the invention.

FIG. 1B shows a schematic representation of a perspective underside view of the housing 21 represented in FIG. 1A.

The housing 21 incorporates a driver receptacle 23 in the housing 21, which is designed for the at least partial accommodation of a light source driver 24 in the housing 21.

The driver receptacle 23 is thus specifically designed to retain the driver within the housing 21, or to secure or maintain the clearance of the driver within the housing 21 in a predetermined position. In the present case, spacings are provided for this purpose, although circumferential gradations or similar are also conceivable.

The housing 21 further incorporates a circumferential gradation 26, by means of which a socket 10 can be snap-fitted into the housing 21, such that the housing 21 and the socket 10 constitute a single unit. This plug-in connection is preferably configured here in a form-fitted and reversible manner and can, moreover, be executed for example by means of plug-in slots 27.

Figure 2:
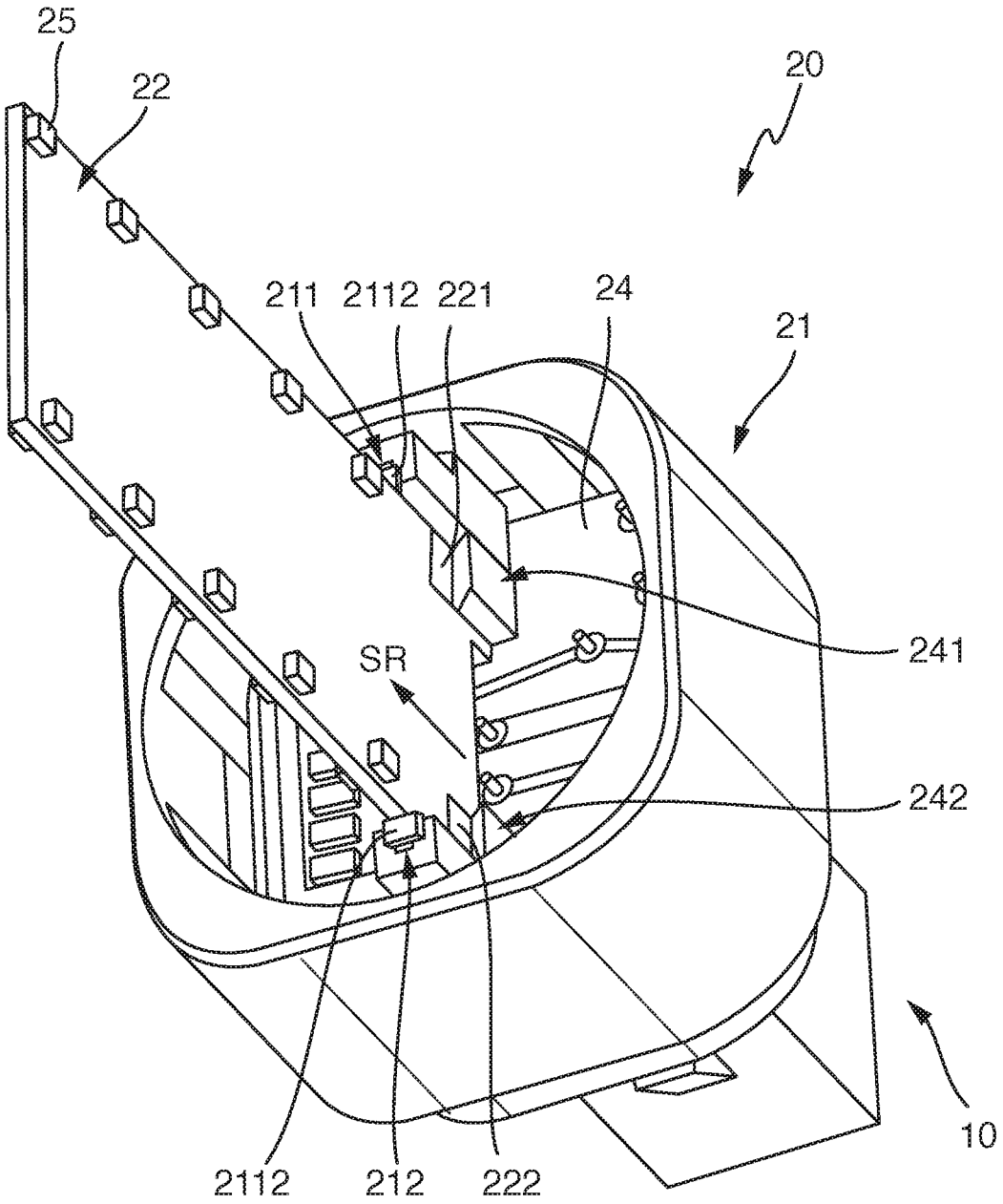
FIG. 2 shows a perspective side view of a lamp base according to the invention, accommodating a form-fitted light source carrier for the support of a light source.

FIG. 2 shows a schematic representation of a perspective side view of a lamp base 20 according to the invention, accommodating a form-fitted light source carrier 22. The lamp base 20 specifically incorporates here the housing 21 represented in FIG. 1A or 1B.

The lamp base 20 is arranged in a form-fitted manner with a socket 10 and accommodates a light source carrier 22 in a form-fitted manner.

For the form-fitted accommodation of the light source carrier 22, two mutually-opposing guide rails 211, 212 are arranged within the housing 21 of the lamp base 20.

The lamp base 20 further incorporates a light source driver 24, which is arranged in the housing 21 such that the light source carrier 22, upon the insertion thereof into the two mutually-opposing guide rails 211, 212, is substantially perpendicular to the light source driver 24.

A schematically-represented limit stop 2112 is further provided, with which the light source carrier 22 engages upon insertion, in order to achieve a clearly-defined insertion of the light source carrier 22. By the provision of the limit stop 2112, it can specifically be prevented that the light source carrier 22 is inserted too far or is entirely pushed out of the guide rails 211, 212. Assembly is simplified accordingly.

As a preferred direction of assembly, the light source carrier 22 is inserted in the direction of the arrow SR into the lamp base 20, which is already connected to the bulb. By means of the limit stop 2112, an accurate positioning of the light source carrier 22 is achieved, and any damage to the bulb by the light source carrier 22 is simultaneously prevented. Preferably, the light source driver 24 is also arranged perpendicularly within the housing 21, such that the light source driver 24 is horizontally maintained in the housing 21 by means of the driver receptacle 23.

The light source driver 24 is, moreover, both positionally and electrically arranged between the light source carrier 22 and the socket 10. The light source driver 24 by means of the driver receptacle 23, engages with the guide rails 211, 212, or is arranged with only an internal clearance to the guide rails.

The light source driver 24 further incorporates a first and a second contact clip 241, 242, which are arranged on the light source driver 24 with a mutual clearance, such that the contact clips 241, 242, within the housing 21, are oriented adjacently to the guide rails 211, 212.

For the energization of the light source 25 of the light source carrier 22, the light source carrier 22 incorporates two contact surfaces 221, 222, which are arranged with a clearance on the light source carrier 22 such that they engage with the contact clips 241, 242 of the light source driver 24.

The light source carrier 22 is thus retained in the housing by means of the guide rails 211, 212 and the contact clips 241, 242.

Preferably, the light source carrier 22 is arranged within the housing 21 such that the light source 25, specifically the LEDs, of the light source carrier 22 project from the housing 21.

Figure 3A:
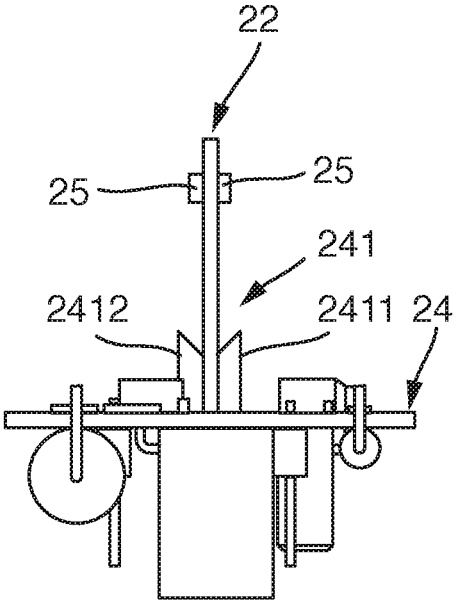
FIG. 3A shows a simplified first side view of a lamp assembly of a lamp according to the invention.

FIG. 3A shows a schematic representation of a simplified first side view of a lamp assembly of a lamp according to the invention, specifically of a connection represented in FIG. 2 between the light source carrier 22 and the light source driver 24.

The light source driver 24 incorporates two contact clips, of which only the first contact clip 241 is visible, for reasons of perspective.

The first contact clip 241 is respectively comprised here of two U-brackets 2411, 2412, which are configured with a mutual clearance and arranged on the light source driver 24, such that a light source carrier 22 can be engaged between the latter.

The light source carrier 22 itself is configured here as described heretofore or hereinafter, and specifically incorporates a light source 25, preferably at least one LED.

Figure 3B:
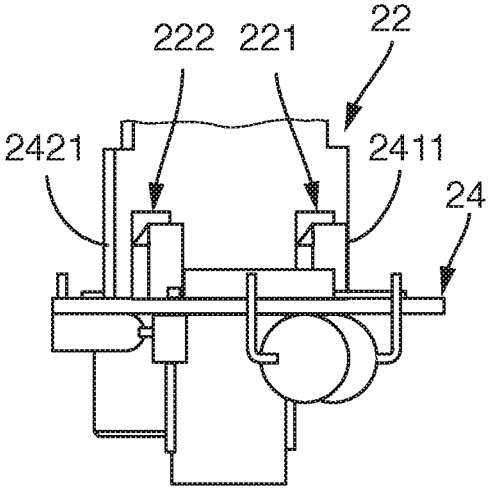
FIG. 3B shows a simplified second side view of a lamp assembly of a lamp according to the invention.

FIG. 3B shows a schematic representation of a simplified second side view of a lamp assembly of a lamp according to the invention, specifically of a connection represented in FIG. 2 between the light source carrier 22 and the light source driver 24.

The light source driver 24 incorporates two contact clips, of which respectively only the first U-brackets 2411, 2421 are visible, for reasons of perspective.

The light source carrier 22 further incorporates a first and a second contact surface 221, 222, which are arranged with a mutual clearance, and encompasses the depth of the light source carrier 22 such that both sides of each contact surface 221, 222 are contacted by the U-brackets 2411, 2412 of the first contact clip 241, or by the U-brackets 2421, 2422 of the second contact clip 242.

The contact clips are configured here such that the light source carrier 22 engages with the contact clips 241, 242, and the light source carrier 22 is substantially perpendicular to the light source driver 24.

Figure 4:
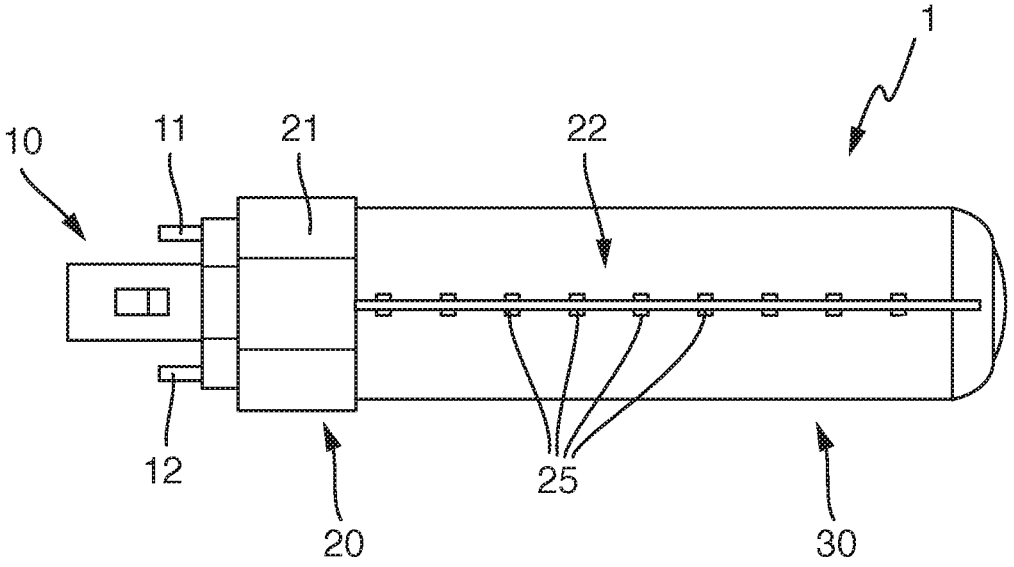
FIG. 4 shows a lamp according to the invention.

FIG. 4 shows a schematic representation of a lamp according to the invention.

The lamp 1 comprises a socket 10 with a first pin contact 11 and a second pin contact 12, a lamp base 20 incorporating a housing 21, a light source carrier 22 and a covering 30.

The socket 10, by means of the pin contacts 11, 12, is designed for bonding with a current source, in order to energize the light source 25 of the lamp.

Preferably, the socket 10 or the lamp base 20 incorporates a ballast, specifically an electronic ballast.

The lamp base 20 is configured as described heretofore or hereinafter, specifically as represented in FIG. 1A, 1B or 2, wherein the lamp base 20 specifically comprises a housing 21 having a first guide rail 211 and a second guide rail 212, which are arranged on the interior of the housing 21.

The light source carrier 22 is inserted into the guide rails in a form-fitted manner.

The light source carrier 22 further comprises a plurality of LEDs which are combined to constitute a light source 25.

Energization of the light source 25, i.e. of the LEDs, in an application according to the invention, proceeds here by means of the pin contacts 11, 12 the light source driver 24, and the light source carrier 22.

To this end, the light source carrier 22 incorporates at least two contact surfaces 221, 222, arranged with a mutual clearance, which are designed, respectively by means of contact clips of the light source driver 24, to form an electrical contact between the light source 25 and the light source driver 24, for the actuation of the at least one light source 25.

The lamp 1 further incorporates a covering 30, which is designed to protect the light source or the LEDs against weathering. The covering 30 is, moreover, preferably of a light-permeable and water-resistant design and is constructed, for example, of plastic or glass.

The lamp according to the invention, specifically by means of the contact clips of the light source driver described heretofore or hereinafter, and by means of the contact surfaces of the light source carrier described heretofore or hereinafter, permits a simple, form-fitted and thus reversible plug-in principle, which specifically permits the cost-effective replacement of defective light sources, specifically by the simple replacement of the light source carrier.

Insofar as applicable, all the individual characteristics which are represented in the exemplary embodiments can be mutually combined and/or interchanged, without departing from the scope of the invention.

LIST OF REFERENCE SYMBOLS

1 Lamp
10 Socket
11 First pin contact
12 Second pin contact
20 Lamp base
21 Housing
211 First guide rail
2111 First guide opening
2112 Limit stop
212 Second guide rail
2121 Second guide opening
22 Light source carrier
221 First contact surface
222 Second contact surface
23 Driver receptacle
24 Light source driver
241 First contact clip
242 Second contact clip
25 Light source
26 Circumferential gradation
27 Plug-in slot
30 Covering
SA Axis of symmetry
SR Direction of installation

The invention claimed is:

1. A lamp base comprising:

a tubular housing having:

a first open end on a first side of the tubular housing configured for at least a partial accommodation of a substantially planar light source carrier configured for carrying a light source such that the substantially planar light source carrier extends from within the first open end to beyond the first open end; and a second open end on a second side of the tubular housing situated opposite the first open end and configured for receiving a socket portion such that the socket portion extends from within the second open end to beyond the second open end;

two mutually-opposing guide rails configured for the form-fitted insertion of the substantially planar light source carrier therein through the first open end, wherein the two mutually-opposing guide rails extend from an interior sidewall of the tubular housing and are distally spaced opposite one another about a periphery of an interior of the tubular housing; and a driver receptacle in the tubular housing at least partially accommodating of a light source driver in the tubular housing, wherein the driver receptacle is configured such that the light source driver is positionally and electrically arranged between the substantially planar light source carrier and the socket portion.

2. The lamp base according to claim 1, wherein the two mutually-opposing guide rails each incorporate a rail opening, which are arranged to face each other.

3. The lamp base according to claim 2, wherein the rail openings are respectively configured over a full length of the two mutually-opposing guide rails.

4. The lamp base according to claim 1, further comprising a limit stop in the two mutually-opposing guide rails for limiting of a depth of insertion of the substantially planar light source carrier.

5. The lamp base according to claim 1, wherein the tubular housing and the two mutually-opposing guide rails comprise a same electrically non-conductive material.

6. The lamp base according to claim 1, further comprising the light source driver disposed within the tubular housing, wherein the substantially planar light source carrier inserted within the two mutually-opposing guide rails is substantially perpendicular to the light source driver.

7. The lamp base according to claim 6, wherein the light source driver includes a first contact clip and a second contact clip which are arranged with a mutual clearance on a substrate of the light source driver and oriented adjacently to the mutually-opposing guide rails.

8. The lamp base of claim 7, wherein the first contact clip and the second contact clip extend from a substrate of the light source driver.

9. A lamp comprising:

the lamp base according to claim 1;

the substantially planar light source carrier configured for carrying the light source; and the light source, wherein the light source comprises at least one light-emitting diode;

wherein the substantially planar light source carrier is inserted in a form-fitted manner in the two mutually-opposing guide rails; and wherein the substantially planar light source carrier includes at least two contact surfaces, arranged with a mutual clearance for contact clips from the light source driver, to form an electrical contact between the light source and the light source driver for the actuation of the light source.

10. The lamp base of claim 1, wherein the tubular housing includes at least one interior plug-in slot formed in the interior sidewall of the tubular housing proximate the second open end of the tubular housing and configured for engaging with the socket portion.

11. The lamp of claim 9, wherein in the at least partial accommodation of the substantially planar light source carrier, the light source is disposed outside of the tubular housing.

12. The lamp base of claim 1, wherein the two mutually-opposing guide rails are situated at least one of:

entirely within the interior of the tubular housing and do not extend beyond the first open end of the tubular housing; and opposite one another across an inner diameter of the tubular housing.

13. The lamp base of claim 1, wherein the exterior of the tubular housing is generally square in cross-sectional profile, as taken transverse to an axis running through the first and second open ends, with the interior of the tubular housing being generally rounded in cross-sectional profile, as taken transverse to the axis running through the first and second open ends.

14. The lamp base of claim 1, wherein the second open end is configured for receiving the socket portion by snap-fitting the socket portion into the second open end, wherein the snap-fitting is provided by physical engagement between a feature of the socket portion and the interior sidewall of the tubular housing.

15. The lamp base of claim 1, wherein the lamp base is configured such that the substantially planar light source carrier plugs into the light source driver within the tubular housing.

16. The lamp base of claim 15, wherein an edge of the substantially planar light source carrier plugs into one or more contacts provided on a substrate of the light source driver.

17. The lamp base of claim 1, wherein the substantially planar light source carrier and the socket portion extend away from the tubular housing in opposing longitudinal axis directions.

18. The lamp base of claim 1, wherein in the at least partial accommodation of the substantially planar light source carrier, the light source is disposed outside of the tubular housing.

19. A lamp base comprising:

a tubular housing having:

a first open end on a first side of the tubular housing configured for at least a partial accommodation of a light source carrier configured for carrying a light source such that the light source carrier extends from within the first open end to beyond the first open end; and a second open end on a second side of the tubular housing situated opposite the first open end and configured for receiving a socket portion such that the socket portion extends from within the second open end to beyond the second open end;

two mutually-opposing guide rails configured for the form-fitted insertion of the light source carrier therein through the first open end, wherein the two mutually-opposing guide rails extend from an interior sidewall of the tubular housing and are distally spaced opposite one another about a periphery of an interior of the tubular housing; and a driver receptacle in the tubular housing at least partially accommodating of a light source driver in the tubular housing, wherein the driver receptacle is configured such that the light source driver is positionally and electrically arranged between the light source carrier and the socket portion; and the socket portion disposed within the second open end of the tubular housing and configured to electrically couple the light source with a current source external to the lamp base, wherein the socket portion includes at least two pin contacts disposed thereat and configured to electrically couple the current source and the light source, wherein the at least two pin contacts extend away from the second side of the tubular housing.

20. A lamp comprising:

the lamp base according to claim 19;

the light source carrier configured for carrying the light source; and the light source, wherein the light source comprises at least one light-emitting diode;

wherein the light source carrier is inserted in a form-fitted manner in the two mutually-opposing guide rails; and wherein the light source carrier includes at least two contact surfaces, arranged with a mutual clearance for contact clips from the light source driver, to form an electrical contact between the light source and the light source driver for the actuation of the light source.

* * * * *